US005310081A

United States Patent [19]

McCabe

[11] Patent Number: 5,310,081

[45] Date of Patent: May 10, 1994

[54] INTEGRAL BEVERAGE CONTAINER CLOSURE

[76] Inventor: Brad M. McCabe, 18346 Kingsbury St., Northridge, Calif. 91326

[21] Appl. No.: 895,278

[22] Filed: Jun. 8, 1992

Related U.S. Application Data

[63] Continuation-in-part of Ser. No. 600,665, Oct. 22, 1990.

[51] Int. Cl.[5] ..... B65D 51/18

[52] U.S. Cl. ..... 220/715; 220/254; 220/259; 220/306; 220/345; 220/361; 220/367; 222/484; 222/511; 222/561; 222/570

[58] Field of Search ..... 220/703, 711, 713, 714, 220/715, 254, 256, 259, 306, 345, 361, 367; 222/484, 511, 561, 570, 1

[56] References Cited

U.S. PATENT DOCUMENTS

| | | | |
|---|---|---|---|
| 1,157,537 | 10/1915 | Hess | 222/511 |
| 1,249,289 | 12/1917 | Bigoney | 222/511 |
| 1,627,781 | 5/1927 | Kendall | 222/511 |
| 1,730,870 | 10/1929 | Wilson | 222/511 |
| 1,800,936 | 4/1931 | Ganger | 222/511 |
| 2,071,960 | 2/1937 | Wilson | 222/561 X |
| 2,202,653 | 5/1940 | Glidden | 222/511 |
| 2,480,733 | 8/1949 | Hermani | 220/254 X |
| 3,332,586 | 7/1967 | Amburgey | 220/345 X |
| 3,506,168 | 4/1970 | Dowdy et al. | 222/511 |
| 4,127,212 | 11/1978 | Waterbury | 220/254 |
| 4,170,724 | 10/1979 | Waterbury | 220/346 |
| 4,752,016 | 6/1988 | Eads | 220/253 |
| 4,790,444 | 12/1988 | Terzi | 220/713 X |
| 4,869,389 | 9/1989 | Cerrone, Jr. | 220/713 X |

*Primary Examiner*—Allan N. Shoap
*Assistant Examiner*—Stephen Cronin
*Attorney, Agent, or Firm*—Timothy T. Tyson

[57] ABSTRACT

An integral beverage can closure embodiment (50) having a sealed position for sealing the contents of an opened beverage can (30) and a dispensing position for dispensing the contents is disclosed. A resilient cap (52) with a skirt (54) closely fits over the can rim. The cap defines a tongue (56) that folds over a hinge (82) and is inserted in a slot (60) of the skirt. Both the tongue and the cap have dispensing apertures (64, 68) and vents (66, 70). When the apertures and vents align, the beverage may be dispensed. The can is sealed when the apertures and vents are displaced. The tongue is caused to move between the sealed and dispensing positions by pressing down, with a finger or thumb of the hand holding the can, on a knurled portion (86) of the tongue. In an embodiment (250), the tongue defines a lever (282) configured to be spaced from the beverage can to facilitate gripping the can and lever together. Applying force to the lever moves the tongue between sealed and dispensing positions.

17 Claims, 8 Drawing Sheets

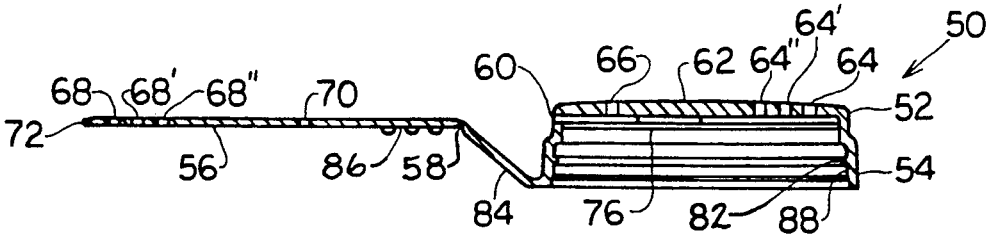
FIG. 5
FIG. 6
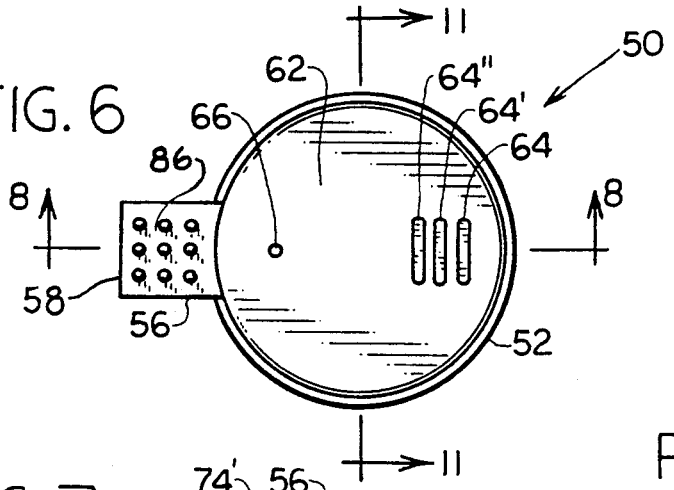
FIG. 7
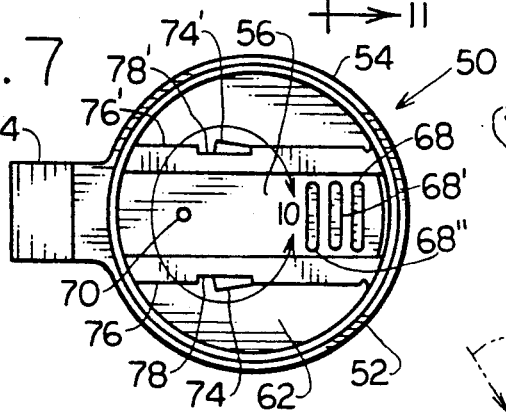
FIG. 8
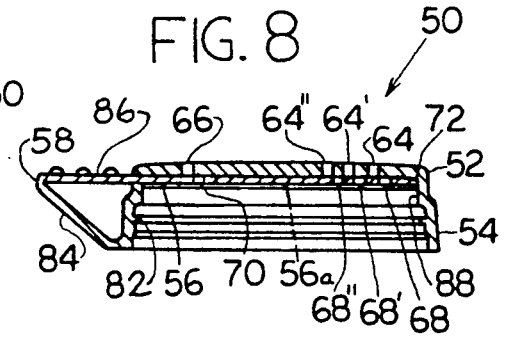
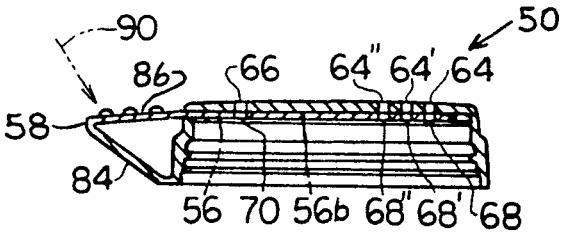
FIG. 9
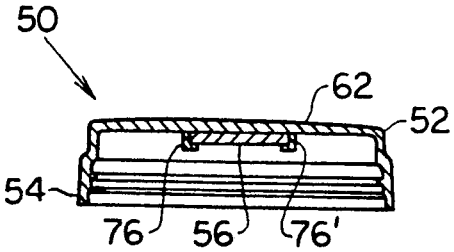
FIG. 11
FIG. 10
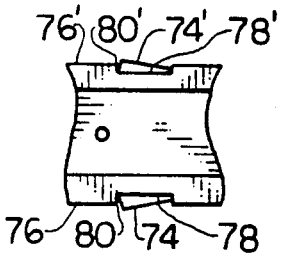

INTEGRAL BEVERAGE CONTAINER CLOSURE

CROSS REFERENCES TO RELATED APPLICATIONS

This application is a continuation-in-part of application Ser. No. 07/600,665, filed Oct. 22, 1990, the disclosure of which is hereby incorporated by reference and made a part hereof.

TECHNICAL FIELD

The present invention pertains to beverage container closures, and more particularly, to integral closures.

BACKGROUND ART

The two piece aluminum can having a non detachable tab has become pervasive in the beverage container field. The can is convenient to use and economical to manufacture, store and ship. It has, however, always had one problem. If the entire contents are not consumed at the initial opening, the non detachable tab cannot be maneuvered to cause the can to be resealed. If the can is left for any appreciable length of time in the open configuration, the carbonation in the remaining liquid escapes and the resulting beverage is less than satisfactory. In addition, the contents are susceptible to contamination from dust, debris and insects.

Closures for this and other types of containers are addressed in U.S. Pat. Nos. 1,157,537; 1,249,289; 1,627,781; 1,730,870; 1,800,936; 2,071,960; 2,202,653; 2,480,733; 3,332,586; 3,506,168; 4,170,724; 4,127,212; 4,752,016; 4,790,444; 4,842,159 and 4,869,389;

DISCLOSURE OF INVENTION

The present invention is directed to an integral closure for an opened beverage container (e.g. detachable tab beverage can).

Closures in accordance with the invention are characterized by a resilient cap defining a tongue extending therefrom. The cap is configured to sealingly receive the can top. The cap defines a slot and the cap and tongue each define a dispensing aperture and a vent. The flexible tongue may be bent and inserted through the slot to a dispensing position where the dispensing apertures and vents both align and to a sealed position where they are spaced apart.

In a preferred embodiment, the tongue is slidably received by a guide which urges the tongue to abut the cap.

In a preferred embodiment, the tongue defines a knurled portion configured to facilitate application of force, by a finger or thumb of the hand holding the beverage can, to move the tongue to the dispensing position. The tongue is returned to the sealed position by a resilient portion adjoining the cap.

In another preferred embodiment, the tongue defines a lever configured to be spaced from the beverage can to facilitate gripping the lever and can together. Force applied with a finger or thumb on the lever causes the tongue to move to the dispensing position.

In another preferred embodiment, the tongue defines ridges to abut the cap and inhibit capillary action. The tongue thickness is also tapered to enhance the sealing fit between the cap and guide.

Various structures (e.g. tabs and shoulders) are provided in the embodiments of the invention to automatically define the dispensing and sealed tongue positions.

In accordance with a feature of the invention, the closure configuration facilitates forming it as a single piece in a resilient polymer thus eliminating assembly time of separate parts.

The novel features of the invention are set forth with particularity in the appended claims. The invention will be best understood from the following description of embodiments when read in conjunction with the accompanying drawings.

BRIEF DESCRIPTION OF DRAWINGS

FIG. 5 is a sectional view along the line 5—5 of FIG. 2;

FIG. 6 is a view similar to FIG. 2 with the tongue inserted in the slot;

FIG. 7 is a view similar to FIG. 3 with the tongue inserted in the slot;

FIG. 8 is a sectional view along the line 8—8 of FIG. 6 with the tongue in the sealed position;

FIG. 9 is a view similar to FIG. 8 with the tongue in the dispensing position;

FIG. 10 is a view of the area enclosed by the line 10 of FIG. 7;

FIG. 11 is a view along the line 11—11 of FIG. 6;

MODES FOR CARRYING OUT THE INVENTION

Figure 1:
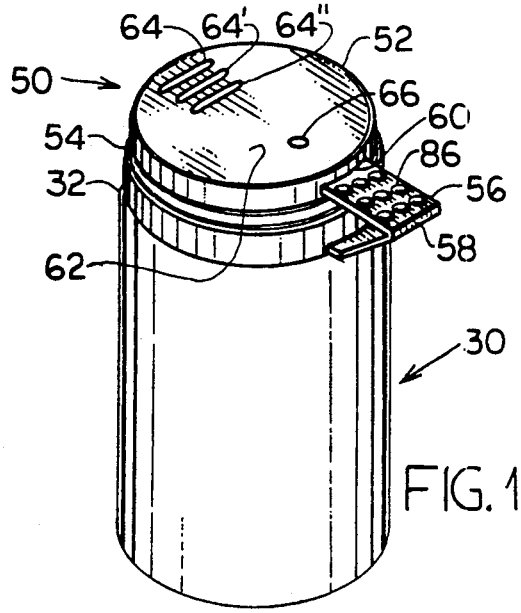
FIG. 1 is a perspective view, in accordance with the present invention, of an integral closure embodiment on a beverage can.

FIG. 1 is a perspective view, in accordance with the present invention, of an integral closure embodiment 50 mounted on a beverage can 30. The closure 50 has a cap 52 with a downward extending skirt 54 that fits closely over the environmental end 32 of the can 30. A tongue 56 extends outward from the skirt 54. It is folded about a hinge 58 and inserted through a slot 60. The tongue 56 has a knurled portion 86. The cap 52 has a roof 62 with beverage dispensing apertures 64, 64' and 64" and a vent 66.

Figure 2:
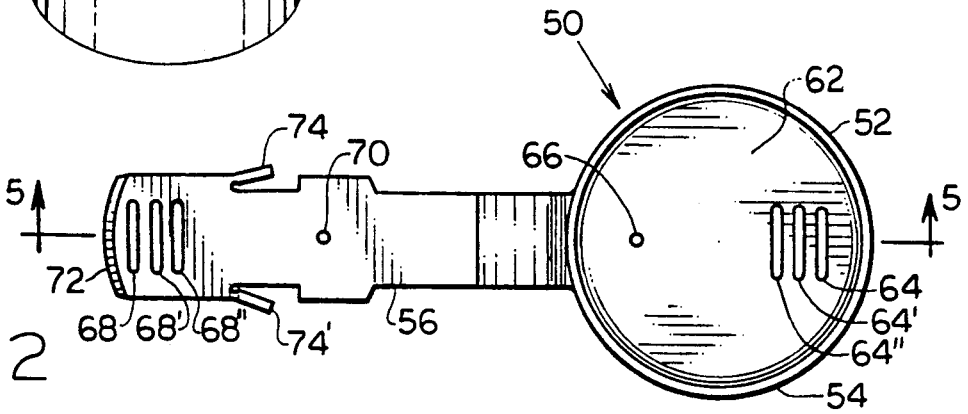
FIG. 2 is a plan view of the closure of FIG. 1.

FIG. 2 is a plan view of the closure 50 showing more clearly that the cap 52 and the outward extending tongue 56 are of one piece. The tongue 56 has dispensing apertures 68, 68' and 68" whose configuration corresponds to the configuration of the roof dispensing apertures 64, 64' and 64". The tongue 56 has a vent 70 whose configuration corresponds to the configuration of the roof vent 66. The tongue 56 has an end 72 and a pair of outward extending resilient tabs 74, 74'.

Figure 3:
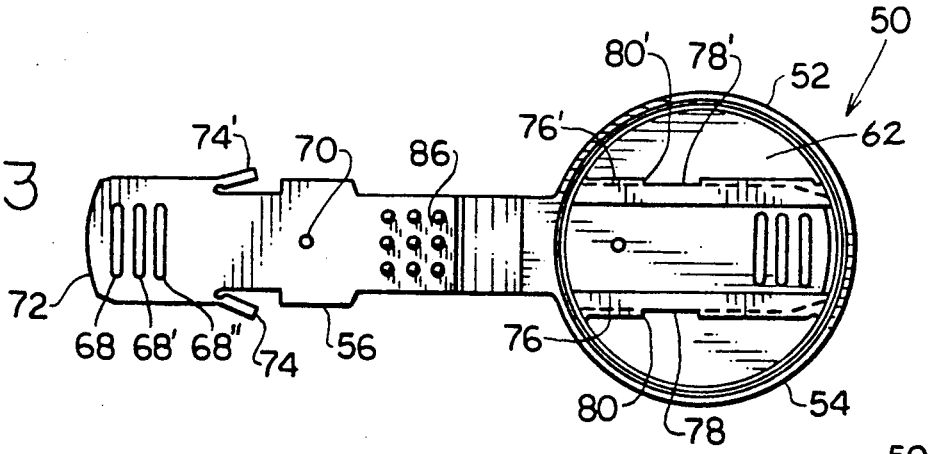
FIG. 3 is a bottom plan view of the closure of FIG. 1.

FIG. 3 is a bottom plan view of the closure 50 showing the knurled portion 58 of the tongue 56. Attached to the underside of the roof 62 are a pair of guides 76, 76'. The guides 76, 76' are L shaped (best seen in FIG. 10) and each have an opening 78, 78' with shoulders 80, 80'.

Figure 4:
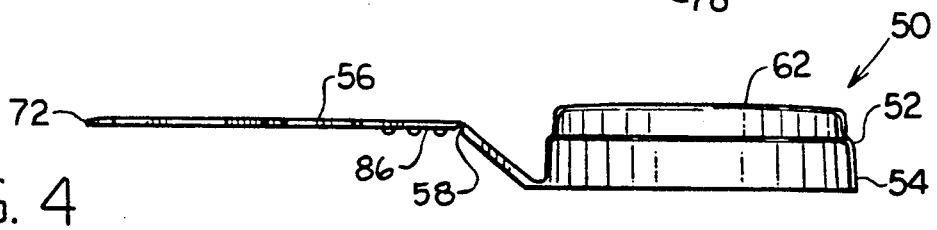
FIG. 4 is an elevation view of the closure of FIG. 1.

The integral configuration of the closure 50 facilitates forming it from a resilient polymer (e.g. polypropolene, polyethylene), in which a hinge 58, shown in the elevation view of FIG. 4, may be realized as a narrowed section known in the plastic molding art as a "living hinge".

FIG. 5 is a sectional view along the line 5—5 of FIG. 2 illustrating the hinge 58 and a resilient portion 84 of the tongue 56. The skirt 54 may be seen to have a bead 82 on its inner surface 88. The dispensing apertures 64, 64' and 64" and vent 66 of the roof 62 and the dispensing apertures 68, 68' and 68" and vent 70 of the tongue 56 are visible in FIG. 5. The slot 60 in the skirt 54 may be seen to align with the guide 76 of the roof 62.

When the tongue 56 is bent with the aid of its hinge 58 and inserted into the slot 60 and the guides 76, 76', the closure 50 appears as is shown in the plan view of FIG. 6 and the bottom plan view of FIG. 7. In FIG. 7 the tongue 56 is seen within the guides 76, 76'. The resilient tabs 74, 74', initially compressed as the tongue 56 slides through the slot 60, have been urged by their resiliency outward into the openings 78, 78' of the guides 76, 76'.

FIG. 8 is a view along the line 8—8 of FIG. 6 illustrating the tongue 56 in the sealed position 56*a* in which the roof dispensing apertures 64, 64' and 64" are displaced relative to the tongue dispensing apertures 68, 68' and 68" and the roof vent 66 is displaced relative to the tongue vent 70. The sealed position 56*a* is obtained by the resilient portion 84 of the tongue 56 urging the end 72 of the tongue 56 to abut the inner surface 88 of the skirt 54.

FIG. 9 is a view similar to FIG. 8 illustrating the tongue 56 in the dispensing position 56*b* in which the roof dispensing apertures 64, 64' and 64" are aligned with the tongue dispensing apertures 68, 68' and 68" and the roof vent 66 is aligned with the tongue vent 70. The dispensing position 56*b* is obtained when force is exerted, as by the index finger of the dispenser 50 user, in the direction 90 against the knurled portion 86 of the tongue 56, thus displacing the resilient portion 84 downwards and urging the tabs 74, 74' to abut the shoulders 80, 80' as shown in FIG. 10 which is a view of the area enclosed by the line 10 of FIG. 7.

Figure 12:
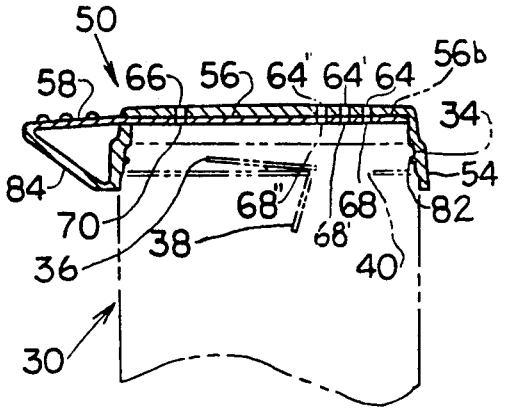
FIG. 12 is a view similar to FIG. 9 with the closure mounted on a beverage can.

FIG. 11 is a view along the line 11—11 of FIG. 6 showing the tongue 56 urged against the roof 62 by the guides 76, 76'. FIG. 12 is a view similar to FIG. 9 illustrating the closure 50 mounted on an opened can 30. The tongue 56 is in the dispensing position 56*b* wherein the tongue dispensing apertures 68, 68' and 68" are aligned with the roof dispensing apertures 64, 64' and 64" and the tongue vent 70 is aligned with the roof vent 66. The pull tab 36 has been used to depress the tab 38 exposing the hole 40 of the can 30. It may be seen that the contents of the can may now be dispensed through the can hole 40 and the dispensing apertures 64, 64', 64", 68, 68' and 68" while air replaces the contents through vents 66 and 70. It is also seen in FIG. 12 that the bead 82 on the inner surface 88 of the skirt 54 is urged inward by the resilience of the skirt 54 to seal the rim 34 of the can 30.

Figure 13:
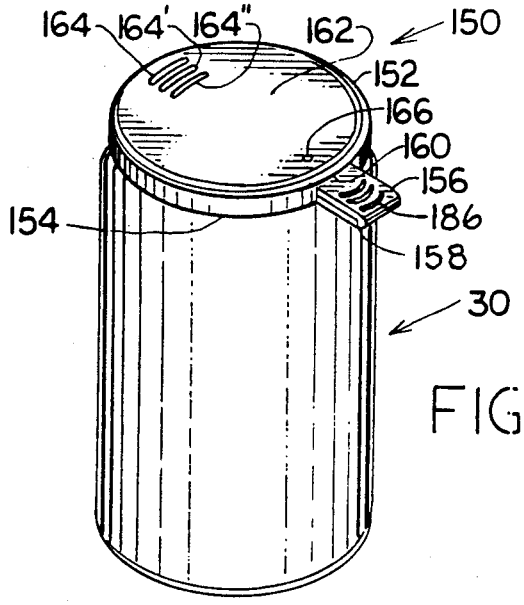
FIG. 13 is a perspective view of another integral closure embodiment on a beverage can.

FIG. 13 is a perspective view of another integral closure embodiment 150 on a beverage can 30. It will be apparent that many of the elements of the closure 150 are similar to the elements of the closure 50. They will, therefore, not be described in detail.

Figure 14:
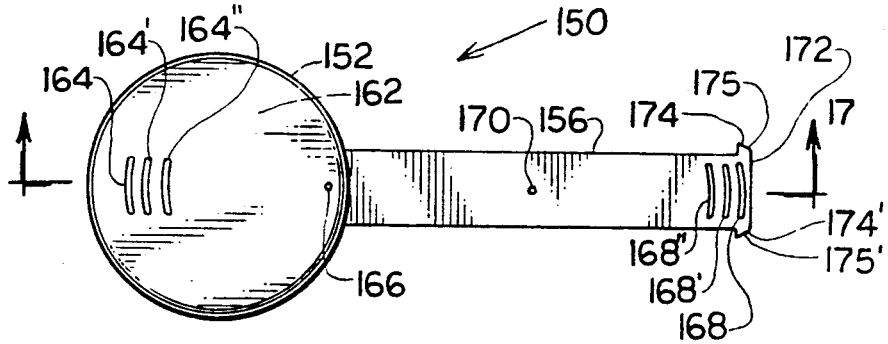
FIG. 14 is a plan view of the closure of FIG. 13.

In FIG. 13, the tongue 156 has been bent with the aid of its hinge 182 and inserted through the slot 160. The roof 162 of the cap 152 has dispensing apertures 164, 164' and 164" and a vent 166. A skirt 154 surrounds the top of the can 30. In FIG. 14, which is a plan view of the closure 150, the tongue 156 is seen to have an end 172 with tabs 174, 174'. The tabs have chamfers 175, 175'. The tongue 156 has dispensing apertures 168, 168' and 168" and a vent 170.

Figure 15:
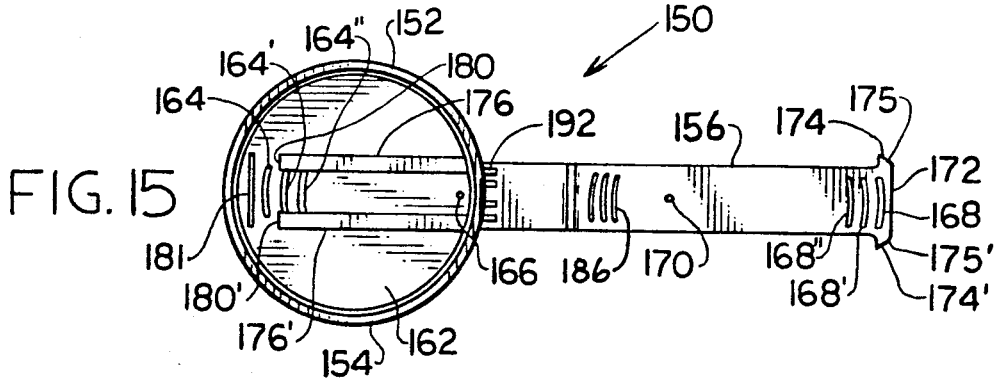
FIG. 15 is a bottom plan view of the closure of FIG. 13.
Figure 16:
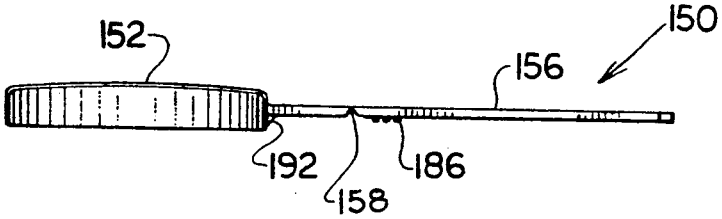
FIG. 16 is an elevation view of the closure of FIG. 13.

FIG. 15 is a bottom plan view of the closure 150 showing the guides 176, 176' attached to the roof 162. The guides 176, 176' end in termini 180, 180'. A stop 181 also descends from the roof 162. The tongue 156 also has a knurled portion 186. FIG. 16 is an elevation view of the closure 150 illustrating the hinge 158.

Figure 17:
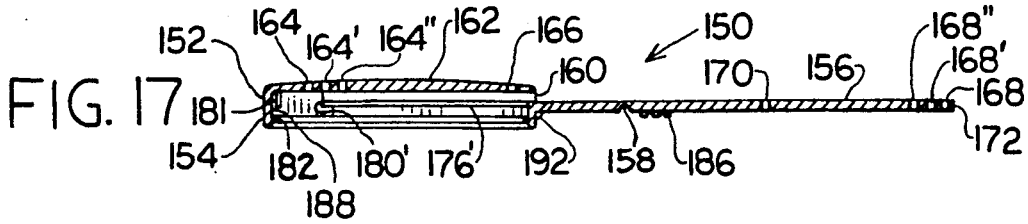
FIG. 17 is a sectional view along the line 17—17 of FIG. 14.
Figure 18:
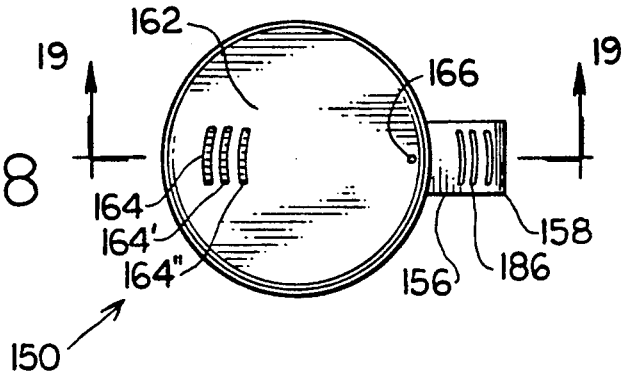
FIG. 18 is a view similar to FIG. 14 with the tongue inserted in the slot.
Figure 19:
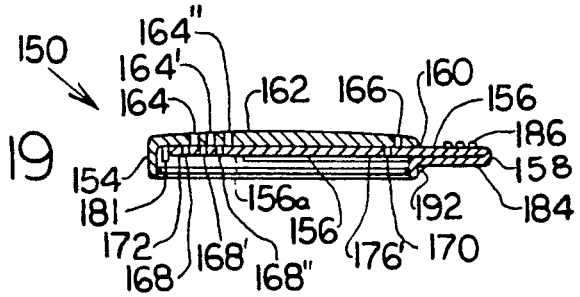
FIG. 19 is a sectional view along the line 19—19 of FIG. 18 with the tongue in the sealed position.

FIG. 17 is a sectional view along the line 17—17 of FIG. 14 illustrating the guide 176' and the stop 181 descending from the roof 162. The bead 182 protrudes from the inner surface 188. When the tongue 156 is bent with the aid of its hinge 158 and inserted into the slot 160, the closure 150 appears as in the plan view of FIG. 18. FIG. 19 is a view along the line 19—19 of FIG. 18 showing the tongue 156 in the sealed position 156*a* wherein the tongue dispensing apertures 168, 168' and 168" are displaced from the roof dispensing apertures 164, 164' and 164" and the tongue vent 170 is displaced from the roof vent 166. In the sealed position 156*a* the end 172 of the tongue 156 is urged against the stop 181 by the resilience of the resilient portion 184 which works against the gussets 192. The tongue 156 is also urged upward against the roof 162 by the guides 176, 176'.

Figure 20:
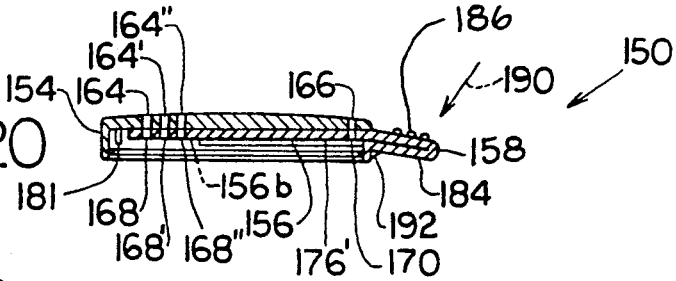
FIG. 20 is a view similar to FIG. 19 with the tongue in the dispensing position.
Figure 21:
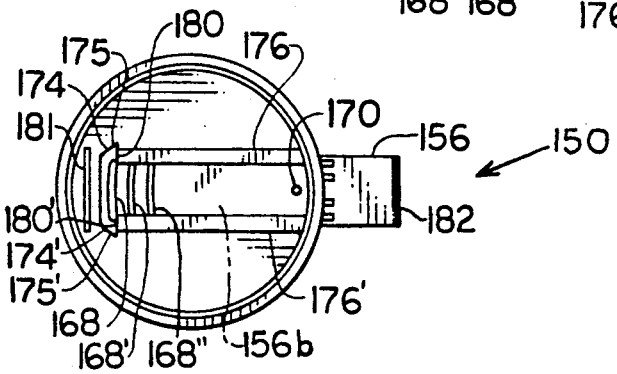
FIG. 21 is a view similar to FIG. 15 with the tongue inserted in the slot.

FIG. 20 is a view similar to FIG. 19 illustrating the tongue 156 in the dispensing position 156*b* wherein the tongue dispensing apertures 168, 168' and 168" align with the roof dispensing apertures 164, 164' and 164"

and the tongue vent 170 aligns with the roof vent 166. Force applied in the direction 190 to the knurled portion 186 of the tongue 156 urges the tongue 156 into this position. FIG. 21, which is a view similar to FIG. 15 with the tongue 156 inserted in the slot 160, illustrates the tongue 156 located in the position **156*b* by the tabs 174, 174' abutting the termini 180, 180'**.

The chamfers 175, 175' ease the transition of the end 172 through the guides 176, 176' when the tongue 156 is initially inserted through the slot 160. The bead 182 (FIG. 17) seals the skirt 154 about the rim of the beverage can as described above for the closure 50.

Figure 22A:
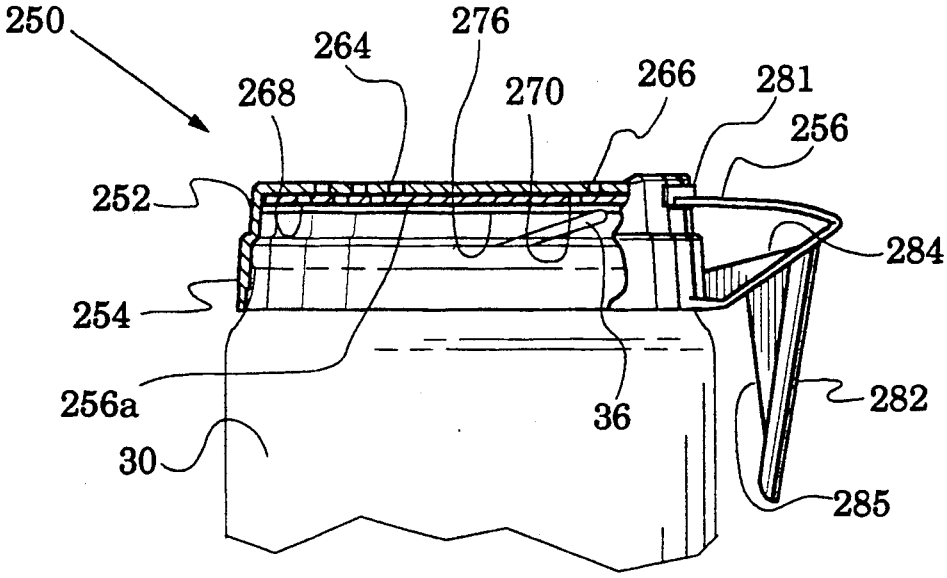
FIG. 22A is an elevation view of another integral closure embodiment installed on a beverage can in the sealed position.

FIGS. 22A and **22*b* are plan views of another integral closure embodiment 250 mounted on a beverage can 30 in, respectively, the sealed and dispensing position. In both views the closure 250 is partially sectioned, revealing the tongue 256 slidably inserted between the cap 252 and a guide 276. In the sealed position 256*a* of the tongue, the tongue aperture 268 and vent 270 are spaced from, respectively, the cap aperture 264 and vent 266 whereas in the dispensing position 256*b* they are aligned. The pull tab 36 of the beverage can 30 is seen below the tongue 256. A collar 281 defined on the tongue 256, abuts the cap 252 to define the tongue sealed position 256*a***.

The tongue 256 also defines a descending lever 282 arranged in a spaced relationship with the beverage can 30 which, for a user of the closure 250, facilitates gripping the can 30 and lever 282 together. When force is then applied to the lever 282 by a thumb or finger, as indicated by the arrow 283, the tongue 256 is urged to the open position **256*b*. The resiliency of the tongue 256 and cap 252 returns the tongue 256 to the sealed position 256*a* when force is removed from the lever 282. Webs 284, 285 defined between the lever 282 and, respectively, the cap 252 and tongue 256 facilitate conversion of the force applied to the lever 282 to movement of the tongue 256. It should be understood that the webs may comprise a single web as shown or multiple webs for additional stiffening. The cap 252 also defines a skirt 254 to grip the beverage can 30** to facilitate a sealed fit therebetween.

Figure 22C:
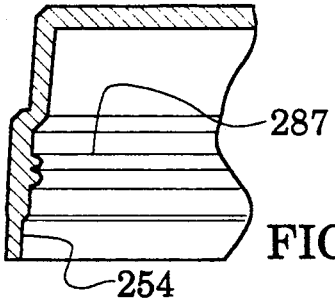
FIG. 22C is an enlarged sectional view of the skirt of the closure of FIG. 22A.

FIG. 22C is an enlarged sectional view of the skirt 254 of the closure 250 illustrating an annular double bead 287 which enhances the seal between the closure and the can 30. The bead may be configured with various contours in addition to the double convex shape shown.

Figure 22B:
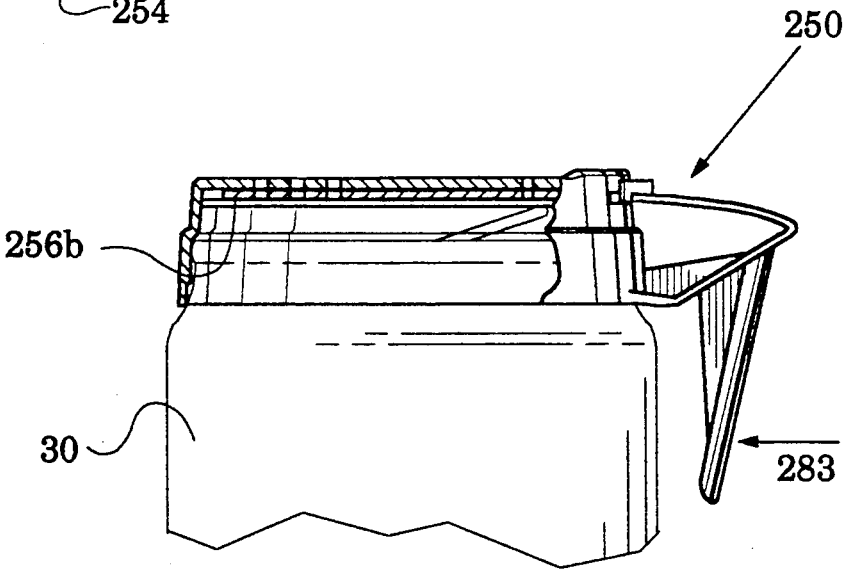
FIG. 22B illustrates the closure of FIG. 22A in the dispensing position.
Figure 23:
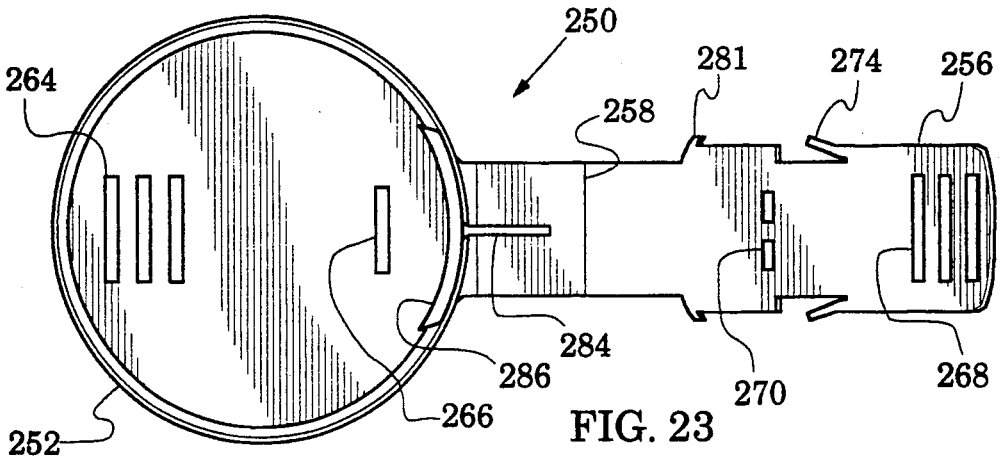
FIG. 23 is a top plan view of the closure of FIG. 22A.
Figure 24:
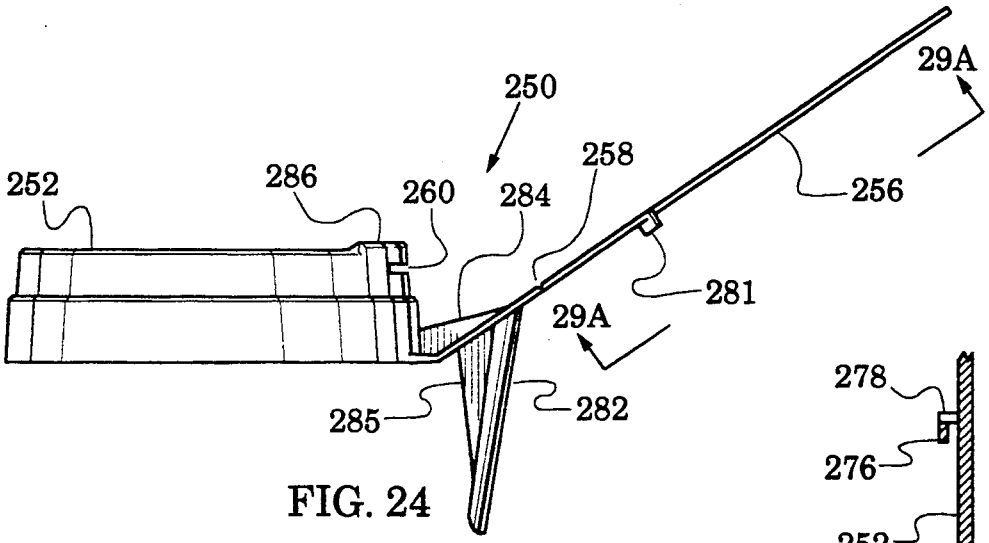
FIG. 24 is an elevation view of the closure of FIG. 22A.
Figure 26:
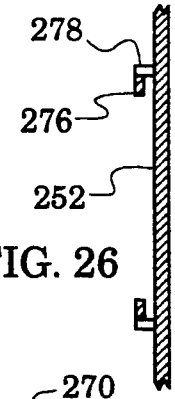
FIG. 26 is an enlarged view along the plane 26—26 of FIG. 25.
Figure 25:
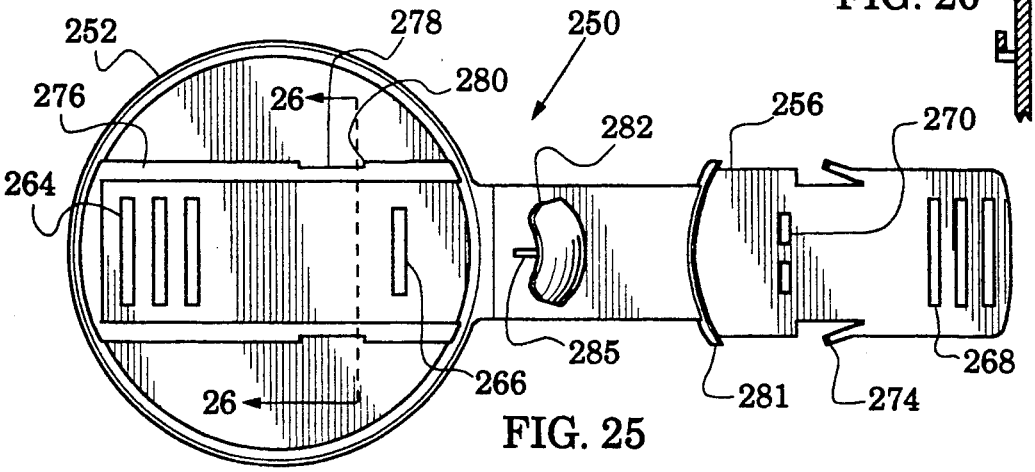
FIG. 25 is a bottom plan view of the closure of FIG. 22A.

FIGS. 23, 24 and 25 are, respectively, top plan, elevation and bottom plan views of the closure 250 before the tongue 256 is bent and inserted through the slot 260 defined in the cap 252. In these views the tongue 256 is seen to define, in addition to the collar 281 and lever 282, flexible tabs 274. The guides 276 each define an opening 278 terminating in a shoulder 280. The tongue 256 also defines a notch 258 to facilitate bending and inserting it into the slot 260. The tongue 256 bends about this notch when fully inserted as shown in FIGS. 22A, 22B. The cap 252 also defines a boss 286 to strengthen the cap above the slot 260. The guides 276 and openings 278 are further illustrated in FIG. 26 which is an enlarged view along the plane 26—26 of FIG. 25. In the closure 250, the dispensing apertures 264, 268 each comprise a plurality of slots, the vent 266 comprises a slot and the tongue vent 270 comprises a double slot.

Figure 27:
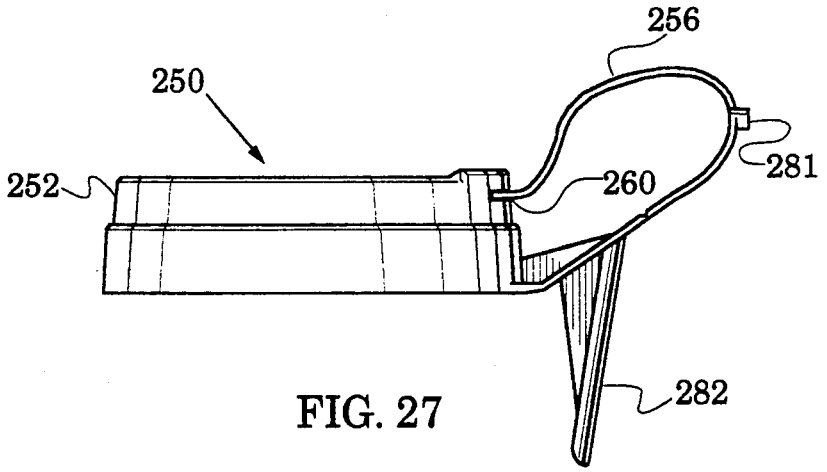
FIG. 27 is an elevation view illustrating, for the closure of FIG. 22A, insertion of the tongue into the cap slot.
Figure 28A:
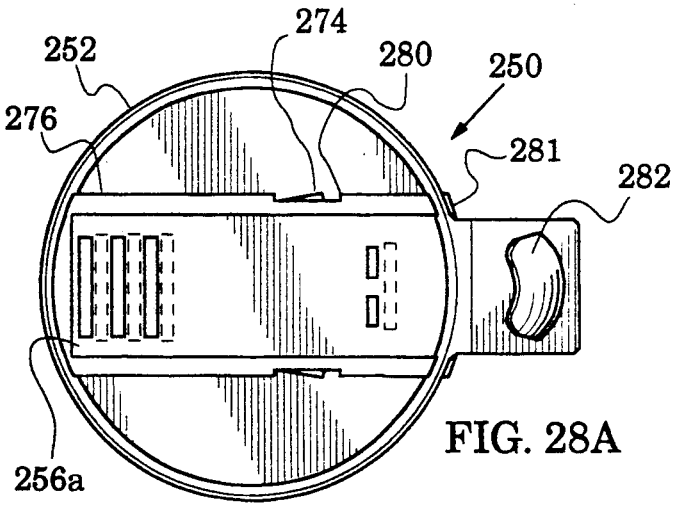
FIG. 28A is a bottom plan view of the closure of FIG. 22A in the sealed position.
Figure 28B:
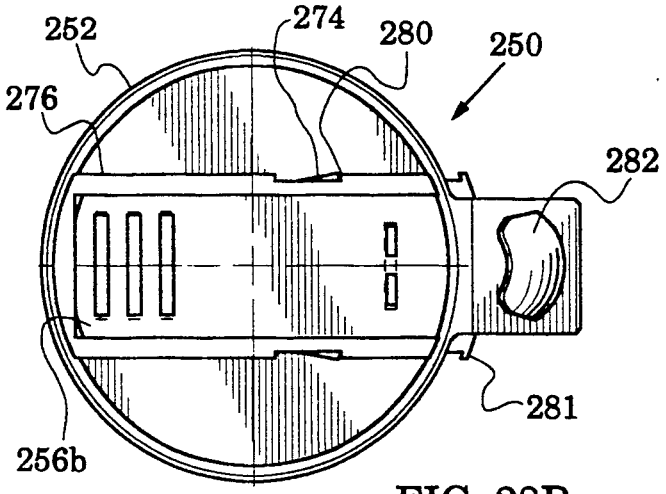
FIG. 28B is a bottom plan view of the closure of FIG. 22A in the dispensing position.

FIG. 27 is a plan view illustrating insertion of the flexible tongue 256 through the slot 260 to the sealed position **256*a* shown in the bottom plan view of FIG. 28A and the dispensing position 256*b* shown in the bottom plan view of FIG. 28B. FIG. 28B also illustrates how the tabs 274 abut the shoulders 280 to define the dispensing position 256*b*. The guide 276 is continuous along the skirt 254 so that the end of the tongue 256 is still received within the guide as is shown in FIG. 28B. It should be understood that the width of the guide 276 may be increased to increase the contact surface between it and the tongue 256**.

Figure 29A:
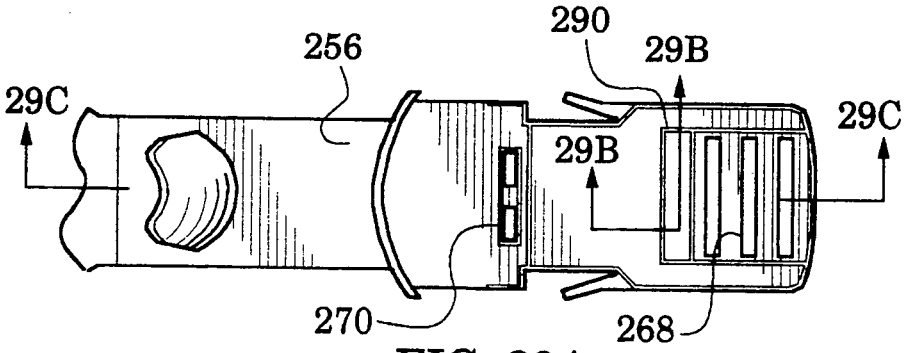
FIG. 29A is a view along the plane 29A—29A of FIG. 24.
Figure 29B:
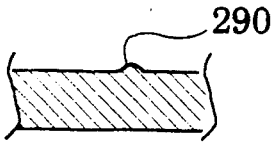
FIG. 29B is a sectional view along the plane 29B—29B of FIG. 29A.

FIG. 29A is a view along the plane 29A—29A of FIG. 24 illustrating that the tongue 256 defines a ridge 290 which inhibits capillary action between the tongue 256 and the cap 252 when the tongue is inserted therein as shown, for instance, in FIGS. 22A, 22B. Adhesive forces which may tend to pull the beverage between the closely fitting planes of the tongue 256 and cap 252 are reduced by the reduced contact area presented by the ridge 290. The ridge 290 is further illustrated in FIG. 29B which is a view along the plane 29B—29B of FIG. 29A. Although the ridge 290 is shown to surround the vent 270 and dispensing aperture 264 and run along the perimeter of the tongue 256 in addition to running transversely in multiple places it may be configured in various ways as required to block capillary action (e.g. it may individually surround each slot of the aperture 268.

Figure 29C:
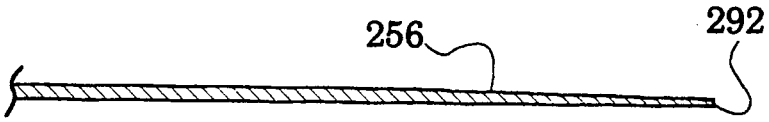
FIG. 29C is a partial view along the plane 29C—29C of FIG. 29A.

FIG. 29C is a partial sectional view (not showing all details) along the plane 29B—29B of FIG. 29A illustrating that the thickness of the tongue 256 is tapered towards the tip 292 to form a wedge shape which enhances the sealing fit between the tongue 256 and the guide 276 and cap 252 when the tongue is inserted therein as shown in FIGS. 28A, 28B.

From the foregoing, it should now be recognized that integral (i.e. one piece) closure embodiments have been disclosed especially suited to seal beverage in, or dispense beverage from, an opened beverage can. In the embodiments of the invention, a cap defines all parts of the closure (e.g. tongue, lever guide) which facilitates economically forming the closure as a single piece in a resilient polymer. Assembly time required by multipart closures is thus eliminated. Although the integral closure embodiments shown are particularly suited to seal open beverage cans, it should be apparent they are also usable on a variety of drinking containers (e.g. coffee cups, child's drinking cup).

The preferred embodiments of the invention described herein are exemplary and numerous modifications, dimensional variations and rearrangements can be readily envisioned to achieve an equivalent result, all of which are intended to be embraced within the scope of the appended claims.

What is claimed is:

1. An integral closure suitable for sealing an open beverage container, comprising;

a resilient cap configured to be sealingly fittable over the beverage container top with a slot and a dispensing aperture defined in said cap;

a resilient tongue defined on said cap and extending therefrom with a dispensing aperture defined in said tongue;

said tongue configured to be bent and slidably inserted through said slot to a beverage dispensing position wherein said tongue aperture and said cap aperture align; and to a sealed position wherein said tongue aperture is spaced from said cap aperture.

2. The closure of claim 1 further including a cap vent defined in said cap and a tongue vent defined in said tongue, said tongue vent positioned to align with said cap vent when said tongue is in said dispensing position, said tongue vent thereby spaced from said cap vent when said tongue is in said sealed position.

3. The closure of claim 1 further including a lever defined on said tongue and extending therefrom to provide leverage to move said tongue from said sealed position to said dispensing position when force is applied to said lever, the resilience of said tongue returning it to said sealed position.

4. The closure of claim 3 further including a first web defined on said tongue and extending between said tongue and said lever to facilitate conversion of said force into movement of said tongue.

5. The closure of claim 3 further including a second web defined on said tongue and extending between said tongue and said cap to facilitate conversion of said force into movement of said tongue.

6. The closure of claim 3 wherein said lever is configured to be spaced from the beverage container, when said closure is installed thereon, to facilitate gripping the beverage container and said lever to apply force thereto.

7. The closure of claim 1 further including a guide defined on said cap and configured to slidably receive said tongue and urge said tongue against said cap.

8. The closure of claim 1 further including a collar defined on said tongue to abut said cap to define said tongue sealed position.

9. The closure of claim 1 further including:

a stop defined on said cap; and an end defined on said tongue to abut said stop to establish said tongue sealed position.

10. The closure of claim 1 further including a notch defined in said tongue to facilitate bending said tongue to insert in said slot.

11. The closure of claim 1 further including a skirt defined on said cap to grip the beverage container to enhance a sealed fit therebetween.

12. The closure of claim 11 further including an annular bead defined on said skirt to enhance the sealing fit between said skirt and said beverage container.

13. The closure of claim 1 further including a knurled portion defined on said tongue to provide friction to move said tongue from said sealed position to said dispensing position when force is applied to said lever, the resilience of said tongue returning it to said sealed position.

14. An integral closure suitable for sealing an open beverage container, comprising:

a resilient cap configured to be sealingly fittable over the beverage container top with a slot and a dispensing aperture defined in said cap;

a resilient tongue defined on said cap to extend therefrom with a dispensing aperture defined in said tongue;

said tongue configured to be bent and slidably inserted through said slot to a beverage dispensing position wherein said tongue aperture and said cap aperture align and to a sealed position wherein said tongue aperture is spaced from said cap aperture;

a guide defined on said cap and configured to slidably receive said tongue and urge said tongue against said cap;

an opening defined on said guide and terminating in a shoulder; and a resilient tab defined on said tongue and configured to resiliently extend into said opening to abut said shoulder to establish said beverage dispensing position.

15. An integral closure suitable for sealing an open beverage container, comprising;

a resilient cap configured to be sealingly fittable over the beverage container top with a slot and a dispensing aperture defined in said cap;

a resilient tongue defined on said cap and extending therefrom with a dispensing aperture defined in said tongue;

said tongue configured to be bent and slidably inserted through said slot to a beverage dispensing position wherein said tongue aperture and said cap aperture align and to a sealed position wherein said tongue aperture is spaced from said cap aperture;

a guide defined on said cap and configured to slidably receive said tongue and urge said tongue against said cap, said guide ending in a terminus; and a tab defined on said tongue to abut said terminus to establish said beverage dispensing position.

16. An integral closure suitable for sealing an open beverage container, comprising;

a resilient cap configured to be sealingly fittable over the beverage container top with a slot and a dispensing aperture defined in said cap;

a resilient tongue defined on said cap and extending therefrom with a dispensing aperture defined in said tongue;

said tongue configured to be bent and slidably inserted through said slot to a beverage dispensing position wherein said tongue aperture and said cap aperture align and to a sealed position wherein said tongue aperture is spaced from said cap aperture;

a guide defined on said cap and configured to slidably receive said tongue and urge said tongue against said cap; and a ridge defined on said tongue and arranged to abut said cap to inhibit capillary action between said tongue and said cap.

17. An integral closure suitable for sealing an open beverage container, comprising;

a resilient cap configured to be sealingly fittable over the beverage container top with a slot and a dispensing aperture defined in said cap;

a resilient tongue defined on said cap and extending therefrom with a dispensing aperture defined in said tongue;

said tongue configured to be bent and slidably inserted through said slot to a beverage dispensing position wherein said tongue aperture and said cap aperture align and to a sealed position wherein said tongue aperture is spaced from said cap aperture; and a guide defined on said cap and configured to slidably receive said tongue and urge said tongue against said cap;

wherein said tongue is tapered to enhance the sealing fit between said tongue and said guide and said cap.

* * * * *